US009752412B2

(12) United States Patent
Shkurti et al.

(10) Patent No.: US 9,752,412 B2
(45) Date of Patent: Sep. 5, 2017

(54) MULTI-PRESSURE TOE VALVE

(71) Applicant: Superior Energy Services, LLC, Harvey, LA (US)

(72) Inventors: Piro Shkurti, The Woodlands, TX (US); Gustavo Oliveira, Houston, LA (US); Iain Greenan, Houston, TX (US)

(73) Assignee: Superior Energy Services, LLC, Harvey, LA (US)

( * ) Notice: Subject to any disclaimer, the term of this patent is extended or adjusted under 35 U.S.C. 154(b) by 0 days.

(21) Appl. No.: 14/874,696

(22) Filed: Oct. 5, 2015

(65) Prior Publication Data

US 2016/0298420 A1 Oct. 13, 2016

Related U.S. Application Data

(60) Provisional application No. 62/144,722, filed on Apr. 8, 2015.

(51) Int. Cl.

| | |
|---|---|
| ***E21B 34/14*** | (2006.01) |
| ***E21B 34/06*** | (2006.01) |
| ***E21B 23/00*** | (2006.01) |
| *E21B 34/00* | (2006.01) |

(52) U.S. Cl.

CPC ..... *E21B 34/14* (2013.01); *E21B 23/006* (2013.01); *E21B 34/063* (2013.01); *E21B 2034/007* (2013.01)

(58) Field of Classification Search

CPC ..... E21B 34/10; E21B 34/063; E21B 34/102; E21B 34/14; E21B 2034/007; E21B 23/004; E21B 23/006

See application file for complete search history.

(56) References Cited

U.S. PATENT DOCUMENTS 3,209,832 A * 10/1965 Tausch ..... E21B 33/1291 166/138
3,273,645 A * 9/1966 Der Mott ..... E21B 23/04 166/117.7
3,420,270 A 1/1969 Neyer
(Continued)

FOREIGN PATENT DOCUMENTS

WO 2013159237 A1 10/2013

OTHER PUBLICATIONS

PCT Application No. US2016/025859; International Search Report and Written Opinion of the International Searching Authority for Applicant Superior Energy Services, LLC dated Jun. 27, 2016.

*Primary Examiner* — Matthew R Buck
*Assistant Examiner* — Aaron Lembo
(74) *Attorney, Agent, or Firm* — Jones Walker LLP

(57) ABSTRACT

A toe valve having an outer tubular member, including at least one outer flow port, and an inner tubular member positioned at least partially within the outer tubular member and including a central flow passage. An indexing mechanism is positioned within the outer tubular member and there is a flow path allowing fluid pressure from the central passage to act against a first side of the indexing mechanism. A biasing device acts on a second side of the indexing mechanism and the indexing mechanism is configured to allow communication between the central flow passage and the outer flow port after the indexing mechanism is subject to a plurality of pressure cycles within the central flow passage.

21 Claims, 12 Drawing Sheets

(56) References Cited

U.S. PATENT DOCUMENTS 3,703,104 A * 11/1972 Tamplen ..... E21B 23/006 166/240
3,986,554 A 10/1976 Nutter
4,321,965 A * 3/1982 Restarick ..... E21B 31/14 166/117.5
4,355,685 A * 10/1982 Beck ..... E21B 23/006 166/240
4,429,747 A 2/1984 Williamson, Jr.
4,650,001 A 3/1987 Ringgenberg
4,781,250 A * 11/1988 McCormick ..... E21B 23/006 134/167 C
4,817,723 A * 4/1989 Ringgenberg ..... E21B 23/006 166/321
4,896,722 A 1/1990 Upchurch
5,048,611 A * 9/1991 Cochran ..... E21B 21/103 166/319
5,095,979 A * 3/1992 Perricone ..... E21B 23/006 166/138
5,335,731 A * 8/1994 Ringgenberg ..... E21B 23/006 166/264
5,529,126 A 6/1996 Edwards
5,535,767 A 7/1996 Schnatzmeyer et al.
5,894,890 A * 4/1999 Garcia-Soule ..... E21B 23/006 166/320
6,257,339 B1 * 7/2001 Haugen ..... E21B 17/06 166/123
6,352,119 B1 * 3/2002 Patel ..... E21B 23/006 166/332.2
6,634,424 B2 10/2003 Knowles
6,659,186 B2 * 12/2003 Patel ..... E21B 23/006 166/332.2
7,108,073 B2 9/2006 Patel
7,139,219 B2 11/2006 Kolle' et al.
7,431,080 B2 * 10/2008 Wright ..... E21B 23/006 166/210
7,591,315 B2 * 9/2009 Dore ..... E21B 17/01 166/338
7,849,925 B2 12/2010 Patel
7,866,402 B2 1/2011 Williamson, Jr.
7,918,279 B2 * 4/2011 Leising ..... E21B 23/006 166/255.2
8,011,434 B2 * 9/2011 Cosgrove ..... E21B 33/038 166/339
8,174,404 B2 5/2012 Hahn et al.
8,272,445 B2 * 9/2012 Fay ..... E21B 23/006 137/625.48
8,276,674 B2 10/2012 Lopez de Cardenas et al.
8,286,717 B2 * 10/2012 Giroux ..... E21B 47/122 166/208
8,316,953 B2 11/2012 Reid et al.
8,443,895 B2 * 5/2013 Harms ..... E21B 23/006 166/339
8,517,113 B2 8/2013 Sheffield
8,555,960 B2 * 10/2013 Mailand ..... E21B 34/063 166/177.4
8,567,509 B1 10/2013 Kippola et al.
8,714,257 B2 5/2014 Kitzman
8,783,354 B2 * 7/2014 Sheehan ..... F16F 1/121 166/178
8,863,843 B2 * 10/2014 Wu ..... E21B 10/32 166/319
8,893,805 B2 11/2014 McGarian
8,978,773 B2 * 3/2015 Tilley ..... E21B 34/14 166/194
9,359,865 B2 * 6/2016 Mailand ..... E21B 23/006
RE46,137 E * 9/2016 Jason ..... E21B 34/063
9,500,063 B2 11/2016 Greenan
2002/0092653 A1 * 7/2002 Scott ..... E21B 23/02 166/338
2009/0126936 A1 5/2009 Begley et al.
2010/0270034 A1 10/2010 Clausen
2010/0314562 A1 12/2010 Bisset
2011/0139433 A1 6/2011 Jackson et al.
2011/0203809 A1 * 8/2011 Knobloch, Jr. ..... E21B 21/103 166/386
2011/0284233 A1 11/2011 Wu et al.
2012/0012322 A1 * 1/2012 Korkmaz ..... E21B 43/26 166/308.1
2012/0042966 A1 * 2/2012 Ross ..... E21B 34/103 137/517
2012/0261131 A1 10/2012 Hofman et al.
2012/0261137 A1 10/2012 Martinez et al.
2012/0279723 A1 11/2012 Hofman et al.
2013/0025872 A1 1/2013 Mailand et al.
2013/0043031 A1 2/2013 Tunget
2013/0056206 A1 3/2013 Jackson et al.
2013/0056220 A1 * 3/2013 Sommers ..... E21B 34/102 166/373
2013/0112427 A1 5/2013 Kolle et al.
2013/0228338 A1 9/2013 Brandsdal
2013/0292110 A1 11/2013 Fraser et al.
2014/0102703 A1 * 4/2014 Mailand ..... E21B 23/006 166/279
2014/0138101 A1 5/2014 Arabsky et al.
2014/0251620 A1 9/2014 George et al.
2014/0299329 A1 10/2014 Kippola et al.

* cited by examiner

DETAIL I

DETAIL I

J SLOT - POSITION 1

J SLOT - POSITION 2

DETAIL I

J SLOT - END POSITION

DETAIL I

MULTI-PRESSURE TOE VALVE

CROSS-REFERENCE TO RELATED APPLICATION

This application claims the benefit under 35 USC §119(e) of U.S. Provisional Application Ser. No. 62/144,722 filed Apr. 8, 2015, which is incorporated by reference herein in its entirety.

BACKGROUND

One stage of recovering hydrocarbon products such as oil and natural gas is known as "completion". Completion is the process of preparing an already drilled well for production and often includes hydraulic fracturing and other well stimulation procedures. Completions also frequently include cementing operations in which cement is pumped through the casing in order to cement the casing into the wellbore. Cementing operations typically include "wiping" the well bore by pumping down the casing a wiper plug in order to "wipe" excess or superfluous cement from the casing.

After cementation the well bore must be re-opened down hole in order to establish communication for stimulation and production. This is typically done with what is known as a "toe valve" or an "initiation valve." Certain toe valves may be opened by pressuring up on fluid in the casing, i.e., pressure activated toe valves. However, it is typically desirable to pressure test the casing prior to opening the toe valve(s). Thus, it is advantageous to be able to pressure test the casing without inadvertently opening the toe valve. The apparatus and methods described herein offers a novel technology for accomplishing these and other objectives.

SUMMARY

One embodiment is a toe valve including an outer tubular member with at least one outer flow port and an inner tubular member positioned at least partially within the outer tubular member and forming an annular space there between, where the inner tubular member includes a central flow passage and at least one inner flow port. A port sleeve is positioned in the annular space to selectively block communication between the outer flow port and the inner flow port. An indexing mechanism is positioned at least partially within the annular space, the indexing mechanism comprising an indexing groove formed in a zigzag pattern and an indexing member traveling in the indexing groove. A flow path allows fluid pressure from the central passage to act against a first side of the indexing mechanism and a biasing device acts on a second side of the indexing mechanism. Finally, the indexing mechanism is configured to allow communication between the central flow passage and the annular space after a plurality of forward/rearward movements of the indexing mechanism.

Another embodiment is a method of opening fluid communication between the interior of a tubular string and a surrounding formation. The method includes the step of positioning a tubular string in a wellbore with a toe valve of the string located in the lowest zone of the wellbore. The toe valve includes an indexing mechanism configured to allow fluid communication between the interior of the tubular string and the wellbore after at least three cycles of the indexing mechanism. Thereafter, at least three cycles of a higher pressure and a lower pressure is applied to fluid within the tubular string in order to operate the indexing mechanism and open the toe valve.

The above paragraphs present a simplified summary of the presently disclosed subject matter in order to provide a basic understanding of some aspects thereof. The summary is not an exhaustive overview, nor is it intended to identify key or critical elements to delineate the scope of the subject matter claimed below. Its sole purpose is to present some concepts in a simplified form as a prelude to the more detailed description set forth below.

DETAILED DESCRIPTION

Figure 1:
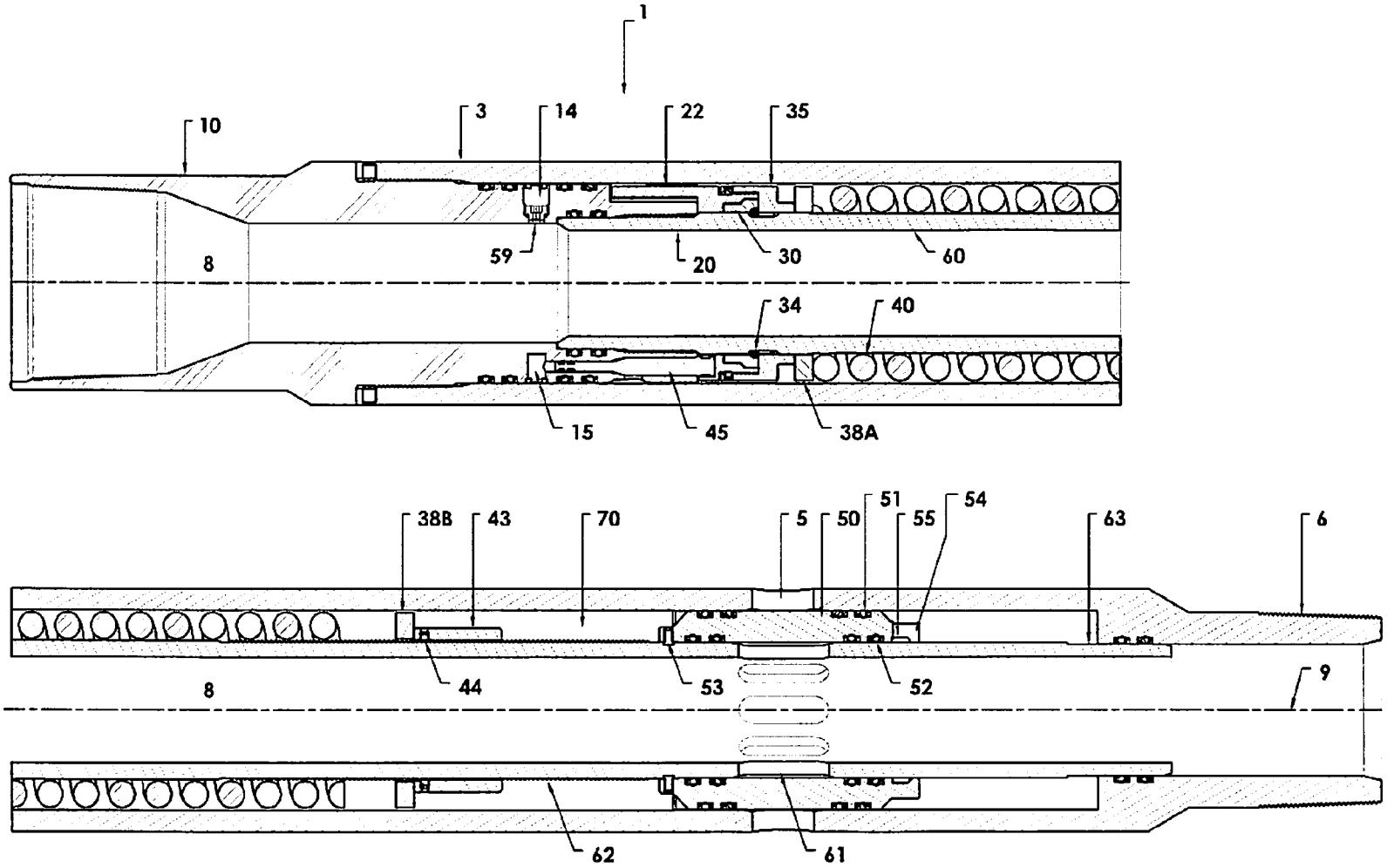
FIG. 1 is a cross-section of one embodiment of the valve of the present invention.

FIG. 1 illustrates a cross-section view of one embodiment of the downhole valve 1 of the present invention. Most generally, the valve is formed of the top sub 10, the housing 3 (sometimes referred to as an "outer tubular member"), and the mandrel 60 (sometimes referred to as an "inner tubular member"). A central flow passage 8 extends through the length of the tool along the long axis 9, i.e., entering through top sub 10, continuing through mandrel 26, and exiting out the lower end of housing 3. This end of housing 3 will include an outer threaded surface 6 for connection to other tubular members to form part of a tubular string (e.g., a string of production tubing). Housing 3 includes at least one flow port 5 and more typically a series of radially positioned flow ports 5, sometimes referred to as "outer flow ports" 5. Mandrel 60 likewise has at least one and more typically a series of flow ports ("inner flow ports") 61, with inner flow ports 61 positioned in general alignment with outer flow ports 5. Housing 3 and mandrel 60 are configured to form an annular space 70 between housing 3 and mandrel 60. Positioned within annular space 70 is the port sleeve 50 which blocks communication between inner flow ports 61 and outer flow ports 5. A series of o-rings 51 on both the inner and outer surfaces of port sleeve 50 complete the fluid-tight barrier between the inner and outer flow ports. The shear screw 53 holds port sleeve 50 in position relative to mandrel 60 until certain pressure conditions are met as explained in detail further below. Also positioned in annular space 70 and over mandrel 60 is the biasing device or spring 40 bounded by spring washers 38A and 38B. The position of spring washer 38B may be adjusted along the length of mandrel 60 by rotating spring nut 43 on the threads 62 formed on the outer surface of mandrel 60 (thereby varying the initial compression of spring 40). Spring nut 43 may be secured in place with set screw 44.

Figures 2A, 2B:
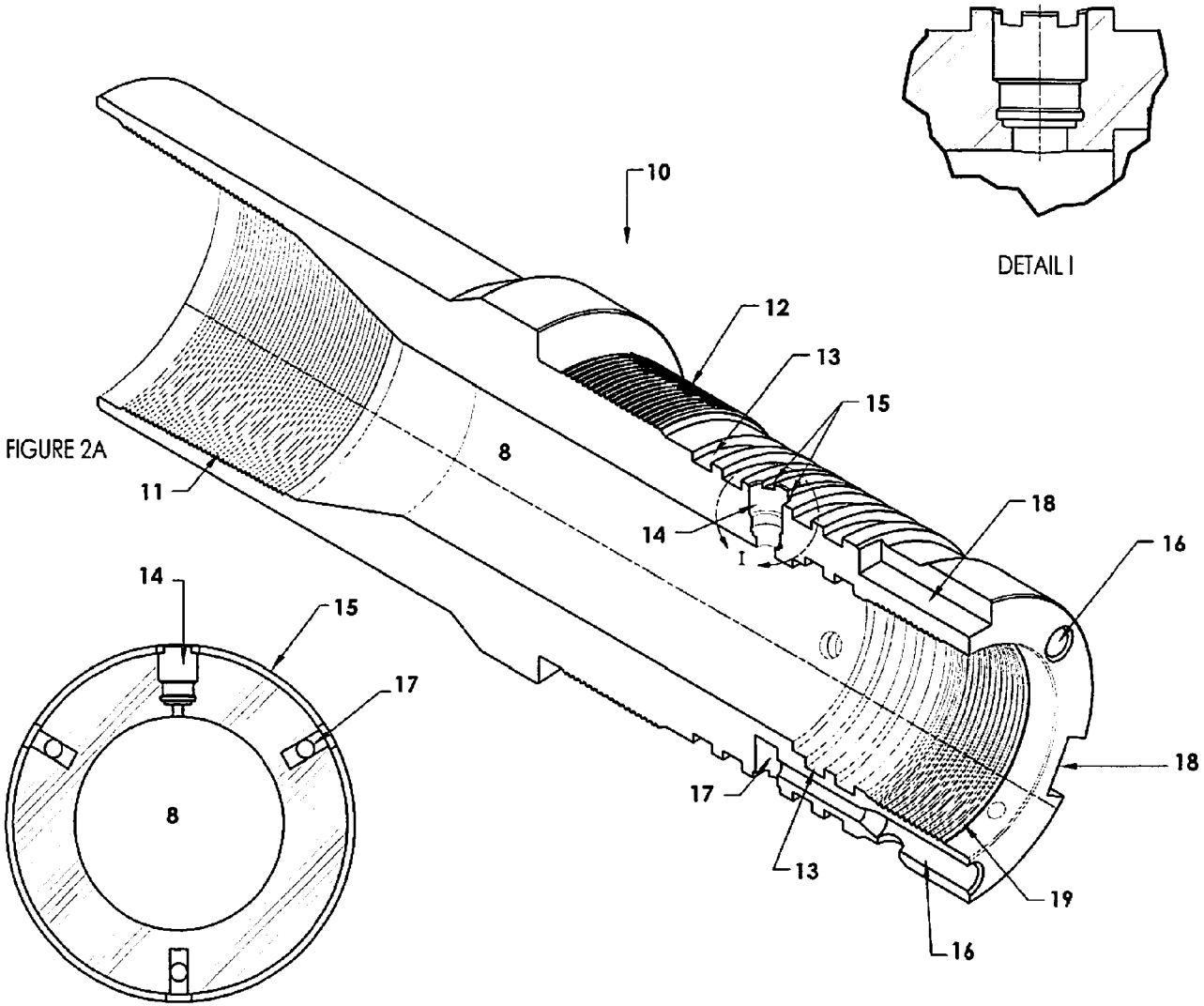
FIG. 2A is a perspective cut-away view of a top sub of the FIG. 1 embodiment.
FIG. 2B is a cross-section through the top sub of FIG. 2A.

The top sub 10 seen in FIG. 1 is shown in more detail in the cut-away perspective view of FIG. 2A. This figure illustrates the internal threads 11 allowing the valve 1 to connect to other tubular members, the external threads 12 for connection to housing 3, and the internal threads 19 for connection of one end of mandrel 60. There is at least one burst disc apertures 14 and external grooves or fluid channels 15 on the outer body of top sub 10 which communicate with fluid connection passage 17. FIG. 2B best illustrates how a fluid path exists from the valves central flow passage 8, into burst disc apertures 14 (two shown in the FIG. 2B embodiment), along fluid channels 15, and into fluid connection passages 17. Obviously, when intact burst discs 59 are positioned within disc apertures 14 (see FIG. 1), this fluid path between central flow passage 8 and fluid connection passages 17 is blocked. However, this path is likewise clearly established when the burst discs are ruptured.

Figure 5:
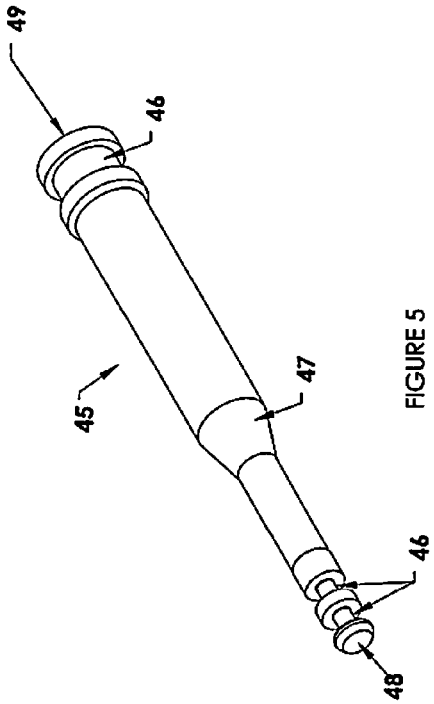
FIG. 5 is a perspective view of a piston of the FIG. 1 embodiment.

FIG. 2A also illustrates how the piston cavity 16 will extend from one face of top sub 10 through to the fluid connection passage 17. Thus, when piston 45 (seen in FIG. 1) is positioned within piston cavity 16, fluid pressure from central flow passage 8 (when the burst discs are ruptured) may act against the end of piston adjacent to and communicating with fluid connection passage 17. FIG. 2B shows the illustrated embodiment has three piston passages (i.e., three pistons 45), but other embodiments could have one, two, four, or more pistons, although between two and four pistons may be more preferred. FIG. 5 shows how one embodiment of piston 45 will have a larger end 49, a smaller end 48, with a conical transition section 47. Each end of piston 45 will have seal grooves 46 to accommodate appropriately sized o-rings. FIG. 2A shows top sub 10 with a series of both internal and external seal grooves 13 to accommodate the o-rings seen in FIG. 1.

Figure 4:
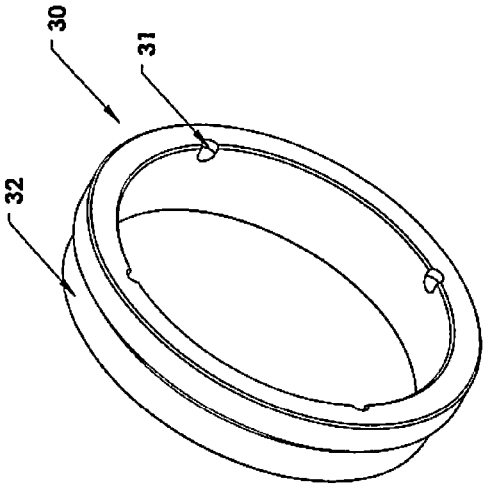
FIG. 4 is a perspective view of an indexing ring of the FIG. 1 embodiment.
Figure 3:
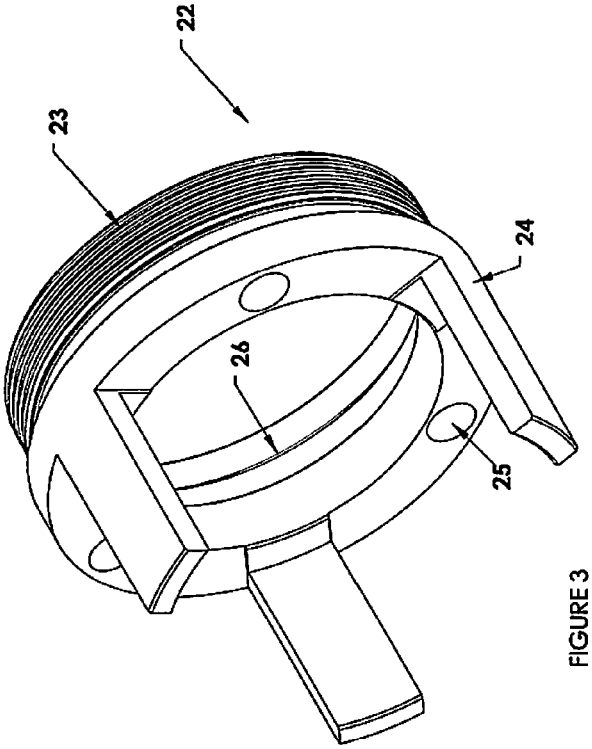
FIG. 3 is a perspective view of a piston guide of the FIG. 1 embodiment.

FIG. 1 shows how this embodiment of valve 1 includes an indexing mechanism 20 (sometimes referred to as "indexing assembly") positioned at the end of top sub 10 and within the annular space 70 formed between housing 3 and mandrel 60. In the illustrated embodiment, indexing mechanism 20 is generally formed of the piston guide 22, indexing ring 30, piston guide cap 35, and indexing member (in this case, "indexing ball") 34. FIG. 3 shows piston guide 22 in more detail. Piston guide 22 is a generally circular member having a series of guide arms 24, piston slots 25, external threads 23, and a guide shoulder 26. The guide arms 24 will engage guide slots 18 on top sub 10 (see FIG. 2A) and allow the piston guide a limited range of movement in the direction of the guide slots 18. As suggested in FIG. 1, indexing ring 30 engages piston guide 22. Viewing FIG. 4, it can be seen how the indexing ring shoulder 32 of indexing ring 30 will rest against the guide shoulder 26 on piston guide 22. Indexing ring 30 will have a series of ball grooves 31 in which will rest the indexing balls 34 (seen in FIG. 1). FIG. 1 further shows how the piston guide cap 35 will be threaded onto the piston guide's external threads 23 in order to secure the indexing ring between piston guide 22 and piston guide cap 35. Spring washer 38A abuts piston guide cap 35 in a manner that force from spring 40 is transmitted to piston guide cap 35.

Figure 6A:
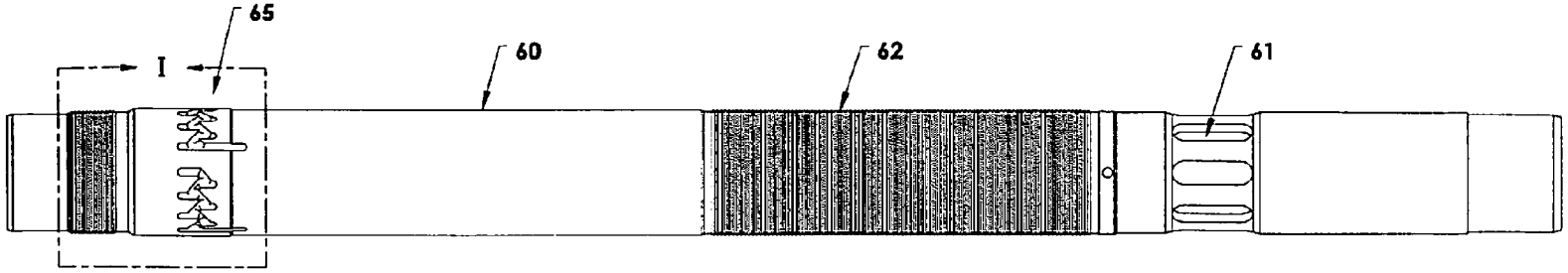
FIG. 6A is a side view a mandrel of the FIG. 1 embodiment.
Figure 6B:
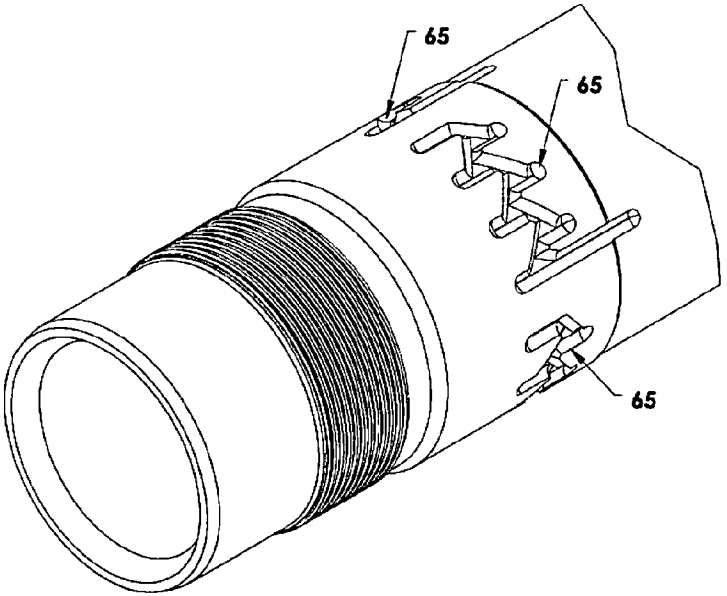
FIG. 6B is a perspective view of indexing grooves on the FIG. 6A mandrel.
Figure 6C:
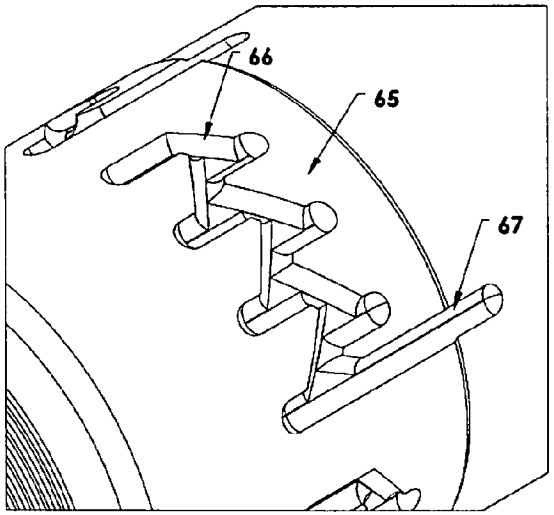
FIG. 6C is a detailed view of the indexing grooves seen in FIG. 6B.

The ball grooves 31 on indexing ring 30 (FIG. 4) are sized such that indexing balls 34 only partially rest in the grooves 31. As seen in FIGS. 6A to 6C, a series of indexing grooves 65 will be formed on the outer surface of mandrel 60. As best seen in FIG. 6C, this embodiment of indexing grooves 65 will be formed in a zigzag pattern running back and forth generally along the long axis of the mandrel. In the illustrated embodiment, the indexing grooves will be formed of a series of short legs 66 moving forward and rearward in an inclined direction (approximately three zigzags in FIG. 6C) and then a final, longer leg extending forward (i.e., toward the inner flow ports 61). FIG. 6B suggests how a series of separate indexing groove patterns 65 may be spaced circumferentially around the outer surface of mandrel 60 to accommodate the four indexing balls suggested by FIG. 4.

Figure 7A:
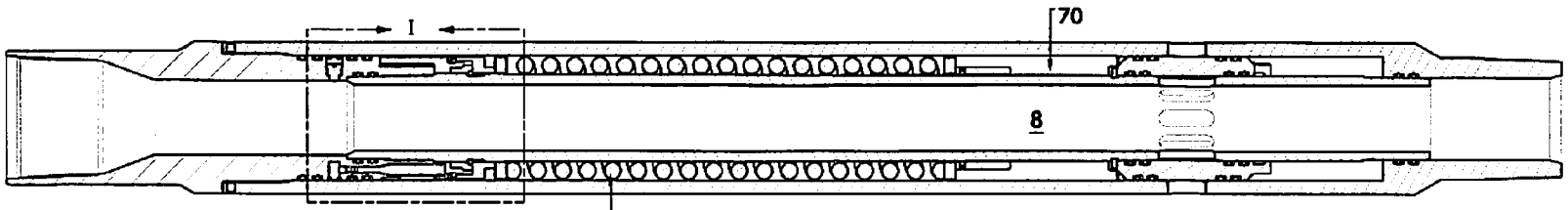
FIGS. 7A to 7C detail one embodiment of an indexing mechanism in a first position.
Figure 7B:
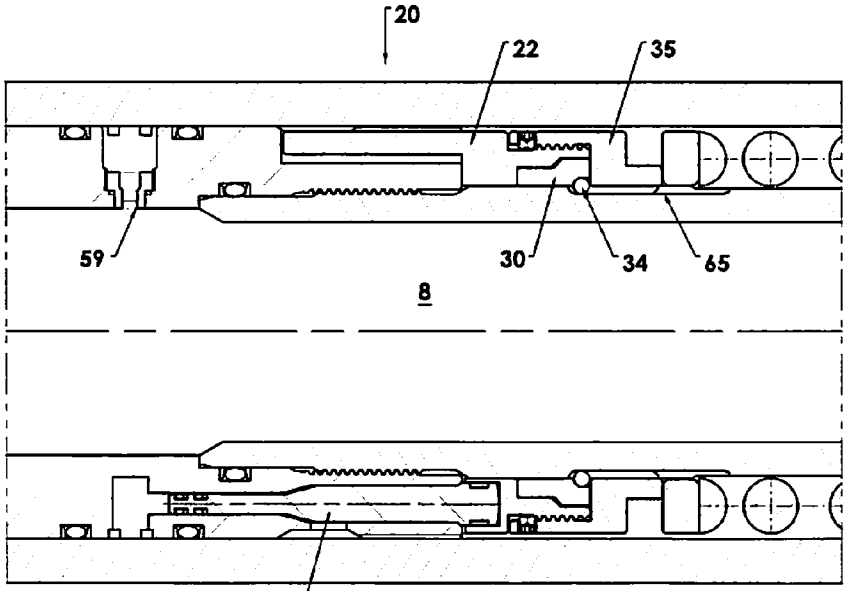
Figure 7C:
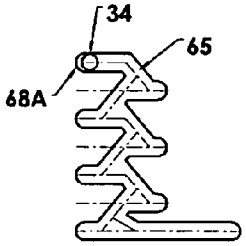
Figure 8A:
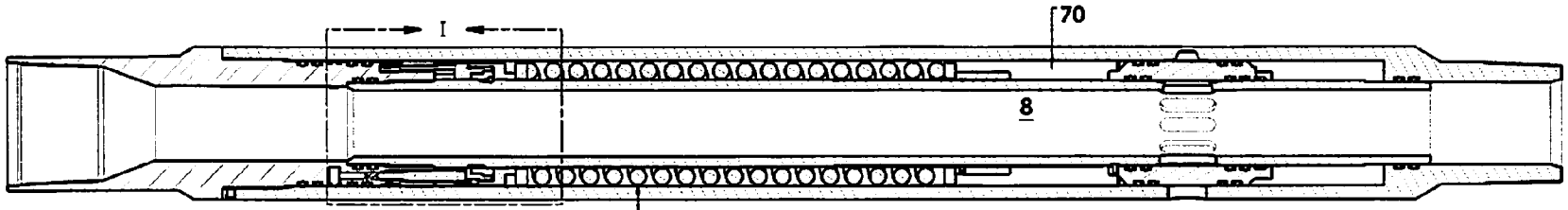
FIGS. 8A to 8C detail the indexing mechanism in a second position.
Figure 8C:
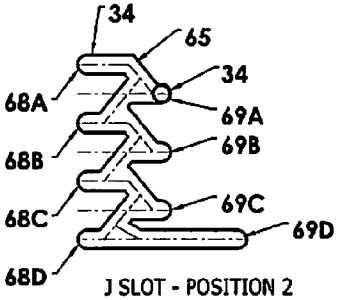
Figure 8B:
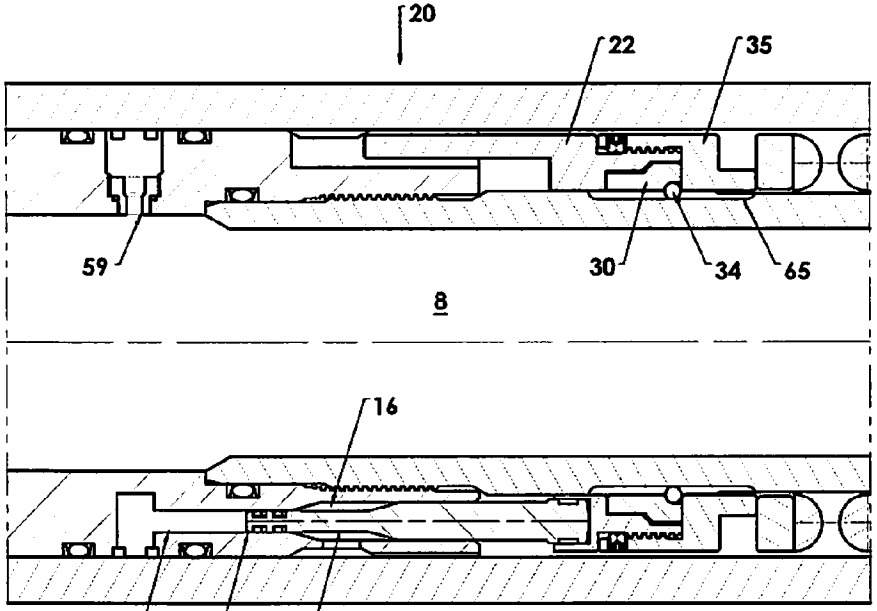
Figure 9A:
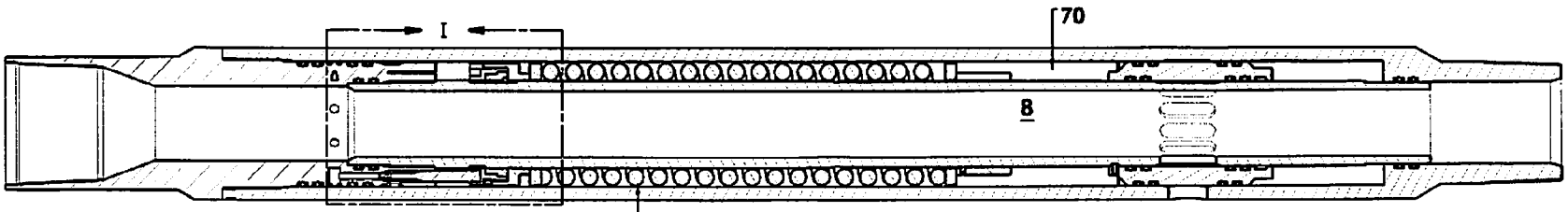
FIGS. 9A to 9C detail the indexing mechanism in its final position.

FIGS. 7 to 9 suggest how the indexing mechanism 20 allows, after a series of forward/rearward movement of the indexing mechanism, for fluid communication to be established between the central flow passage 8 and the annular space. FIG. 7B shows indexing mechanism 20 with indexing ball 34 in its initial position. It will be understood from the previous discussion of FIGS. 2A and 2B, that as long as intact burst discs 59 are in place (as shown in FIG. 1), fluid pressure is not transmitted from central flow passage 8 to the smaller end of pistons 45. In this state, pressure changes in central flow passage 8 will not affect the position of the indexing mechanism. However, once burst discs 59 have ruptured, then fluid pressure in central flow passage 8 will act against pistons 45. FIG. 7B shows the piston 45 fully recessed in piston cavity 16 and spring 40 pushing indexing mechanism 20 into its "rearward" position. As suggested in FIG. 7C, the indexing ball 34 rests to the rear in the first leg of indexing groove 65 (rear groove position 68*a*) at this point in the tool's operation.

FIG. 8B depicts the state after burst disk 59 has ruptured and sufficient fluid pressure has been applied in central flow passage 8 such that the force on the piston's small end 48 overcomes the compressive force of spring 40 (and the friction of the piston o-rings) and piston 45 pushes indexing mechanism 20 "forward." As suggested in FIG. 8C, this travel of indexing mechanism 20 moves indexing ball 34 forward until the ball is in forward groove position 69*a*, at which point further forward movement of ball 34 and indexing mechanism 20 is arrested. It should also be noted at this point in FIG. 8B that the o-rings on the small end 48 of piston 45 still seal against the smaller diameter portion of piston cavity 16. Thus, no fluid is capable of flowing from the area behind piston 45 (i.e., the fluid connection passage 17 seen in FIG. 2B), past indexing mechanism 20, and into annular space 70.

Although not explicitly shown, it may be envisioned from FIG. 8C how, when fluid pressure in central flow passage 8 is sufficiently reduced, spring 40 pushes indexing mechanism 20 back to its starting position, except indexing ball 34 now moves to rear groove position 68*b* and indexing ring 30 rotates slightly to accommodate this angular movement. Then when pressure is again increased sufficiently to move piston 45 and indexing mechanism 20 forward again, the indexing ball is shifted to forward groove position 69*b*. This pressuring up and de-pressuring process can be continued to move the indexing ball into groove positions 68*c*, 69*c*, and 68*d*.

Figure 9C:
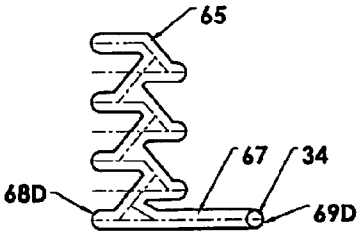
Figure 9B:
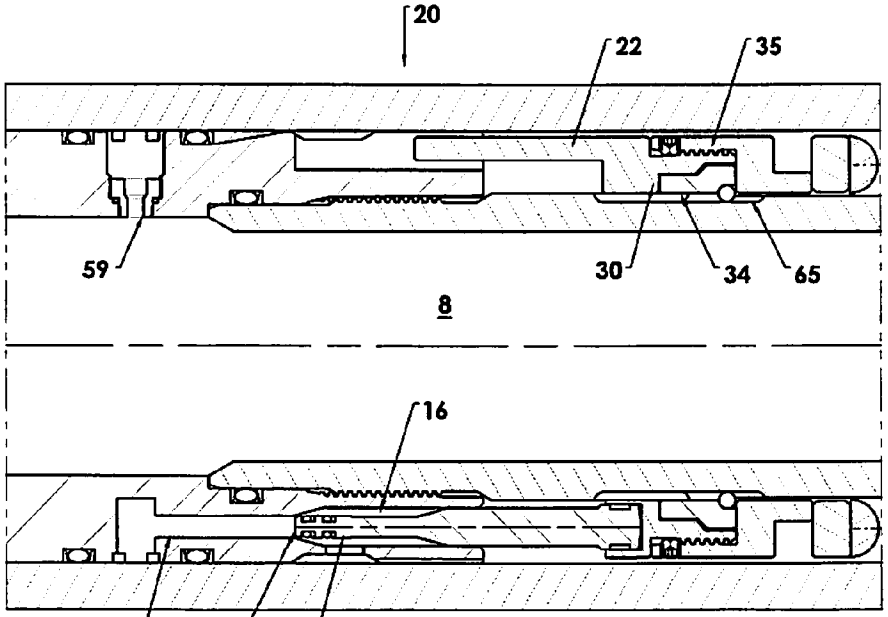

FIGS. 9B and 9C suggest the operation of indexing mechanism 20 when indexing ball 34 is resting in groove position 68*d* and pressure is applied for a final time. Indexing ball 34 now travels a greater distance than previously along the length of long groove leg 67. As seen in FIG. 9B, the small end 48 of piston 45 (and o-rings thereon) now has moved sufficiently far forward to clear the small diameter portion of piston cavity 16. This results in high pressure fluid from central flow passage 8, via fluid connection passage 17, flowing around piston 45, through indexing mechanism 20, and into annular space 70.

Viewing FIG. 1, as soon as annular space 70 is exposed to the fluid pressure of central flow passage 8, this pressure is applied to the upper surface of port sleeve 50. Because shear screws 53 are designed to fail at a force less than that exerted by the central passage pressure on port sleeve 50, the screws are sheared and port sleeve 50 slides forward, thereby unblocking the flow path between outer ports 5 and inner ports 61. Now fluid flowing through central flow path 8 is free to communicate with the environment external to housing 3. It may also be envisioned that as port sleeve 50 moves forward, the lock ring 55 on port sleeve 50 will ultimately encounter the lock groove 63. At this point, lock ring 55 becomes partially positioned in lock groove 63 and partially position in lock ring groove 54, thereby locking port sleeve 50 in the forward (i.e., valve open) position.

Although the figures illustrate the indexing member as a ball, it could be another type of structure, e.g., a pin or key. Likewise, the grooves of the indexing mechanism need not be on the inner tubular member (e.g., on the indexing ring or the piston guide). Nor is the indexing mechanism limited to the that shown in the figures. Alternative indexing mechanisms could include clutch mechanisms, rotational mechanisms, gear type mechanisms, or j-style mechanisms.

Figure 10B:
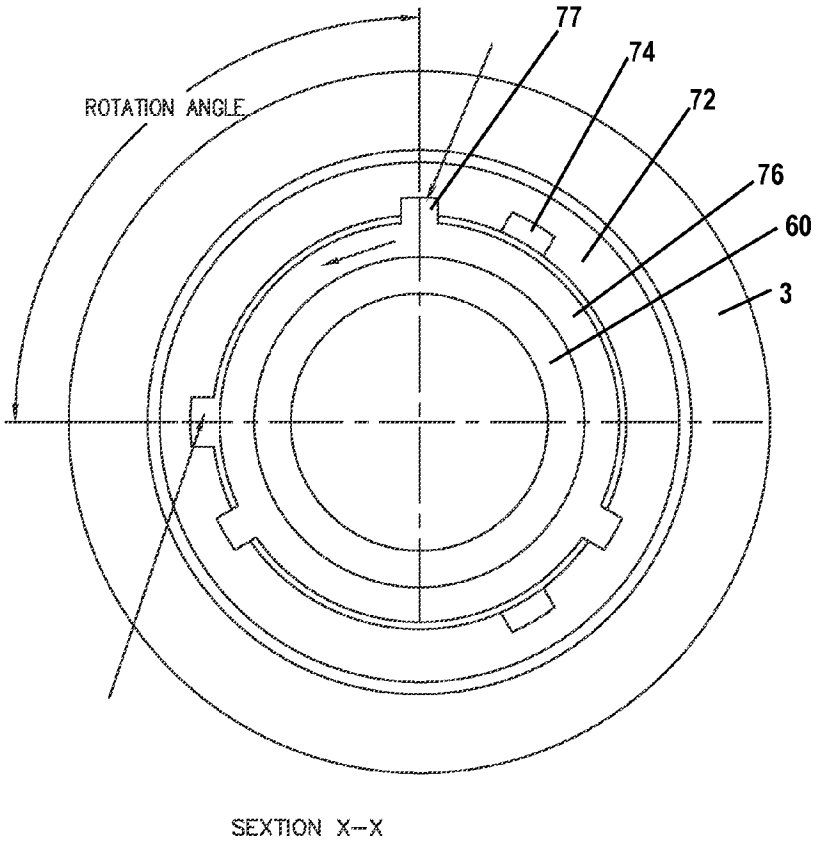
FIGS. 10A to 10F are section views of a second embodiment of an indexing mechanism.
Figure 10A:
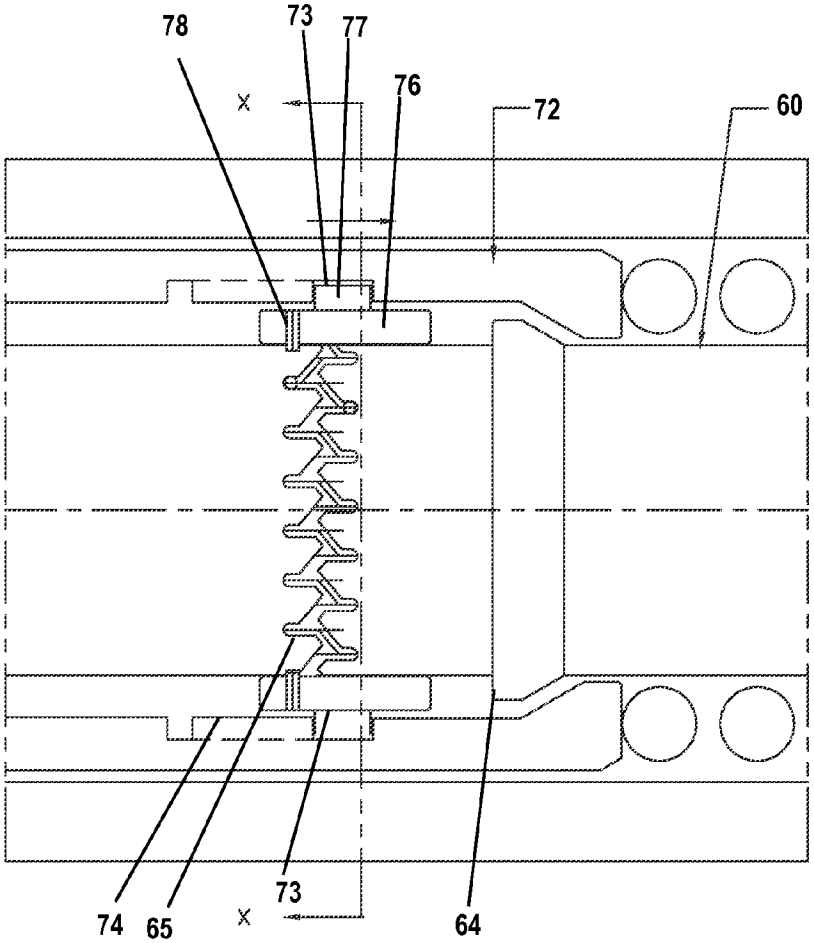
Figure 10D:
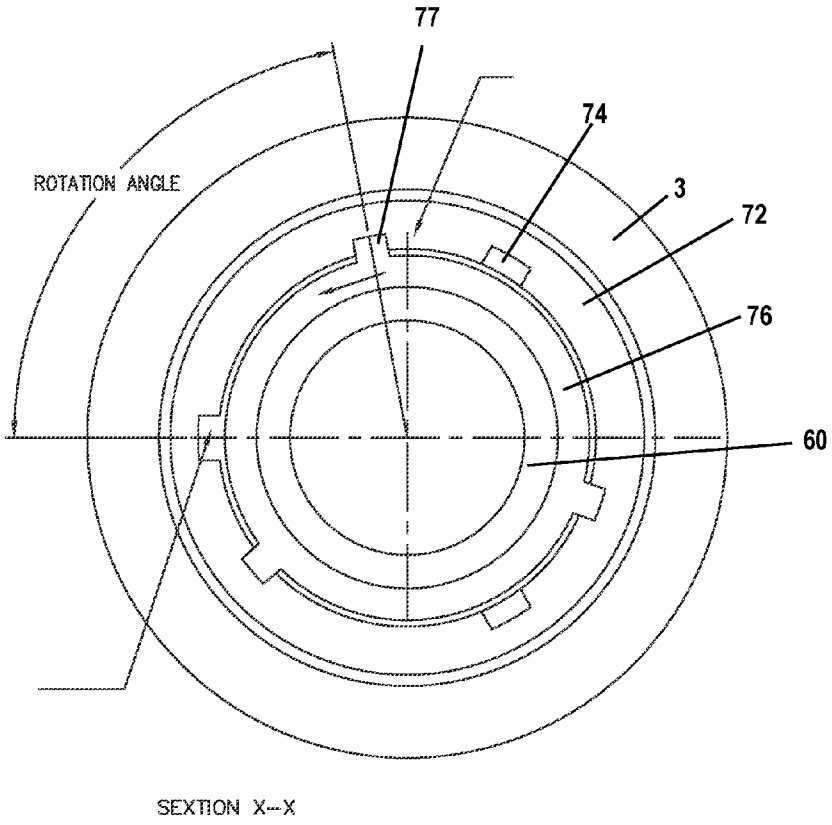

One such alternative indexing mechanism is seen in FIGS. 10A to 10F, which show sectional views of the indexing mechanism. It will be understood that tool components not illustrated to the left and right of FIG. 10A (e.g., piston 45, burst disc 59, port sleeve 50, etc.) are substantially the same as seen in FIG. 1 and function as describe in reference to the indexing mechanism of FIG. 1. In FIG. 10A, the indexing ring 76 is positioned between the mandrel (inner tubular member) 60 and the piston guide 72. Different from the earlier indexing ring 30, indexing ring 76 includes at least one (three in the FIG. 10 embodiment) indexing keys 77 and a corresponding number of indexing pins 78 which engage the indexing grooves 65 on mandrel 60. The indexing keys 77 will be positioned in a circumferential groove or channel 73 formed on the inner surface of piston guide 72. This channel 73 allows indexing keys 77, and thus indexing ring 76, to rotate with respect to piston guide 72, but the channel 73 is not sufficiently wide to allow axial movement (i.e., movement in a direction along the length of the tool body) of indexing keys 77 in channel 73. The cross-section X-X of FIG. 10B suggests how the indexing keys 77 will abut against the faces of channel 73. FIG. 10A also shows how mandrel 60 is different from earlier embodiments in that it now includes the shoulder 64.

Figure 10C:
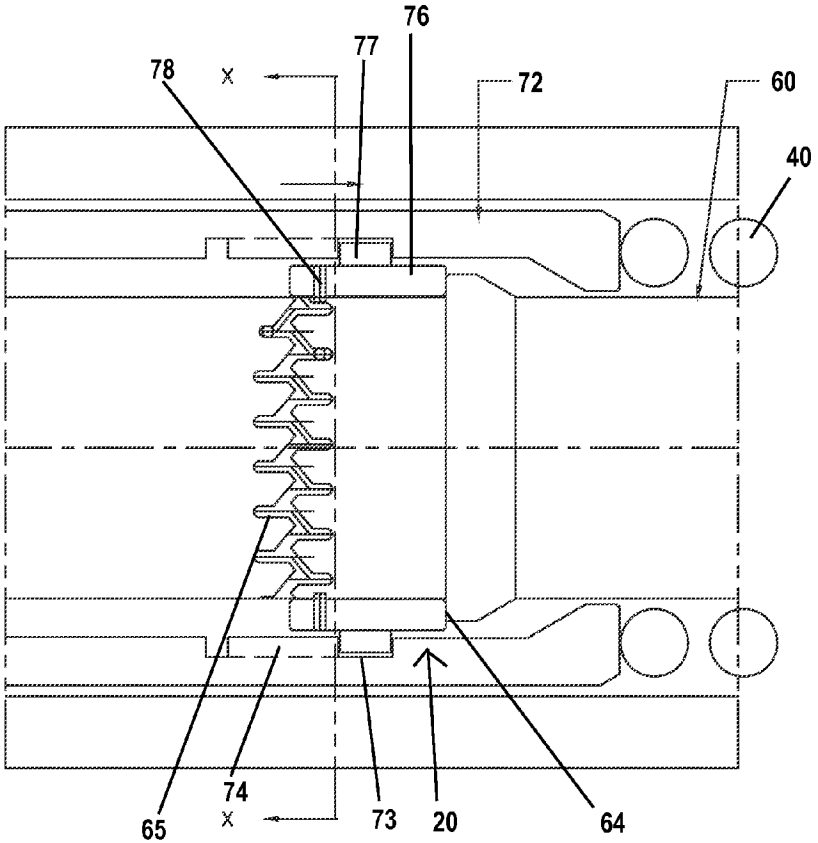
Figure 10F:
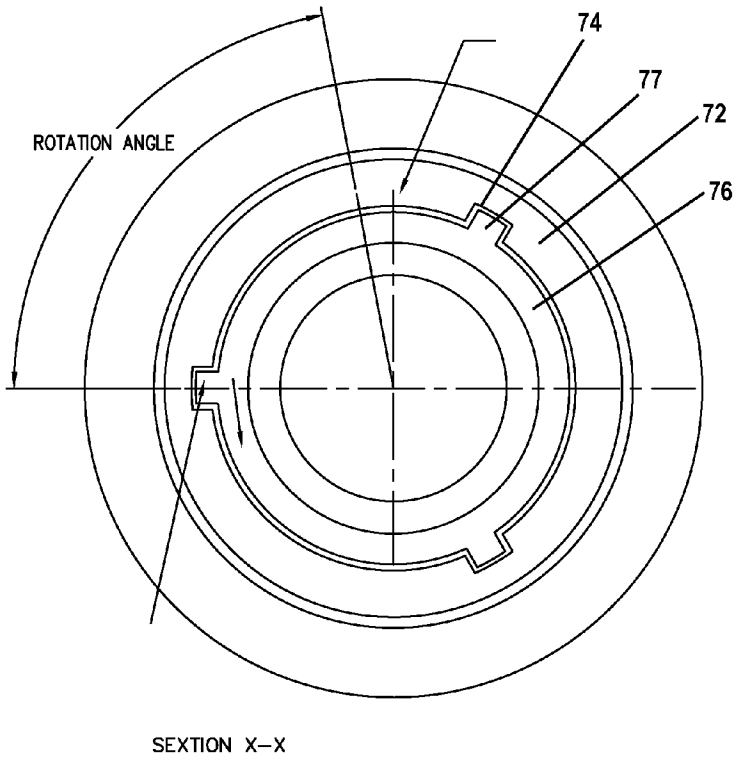
Figure 10E:
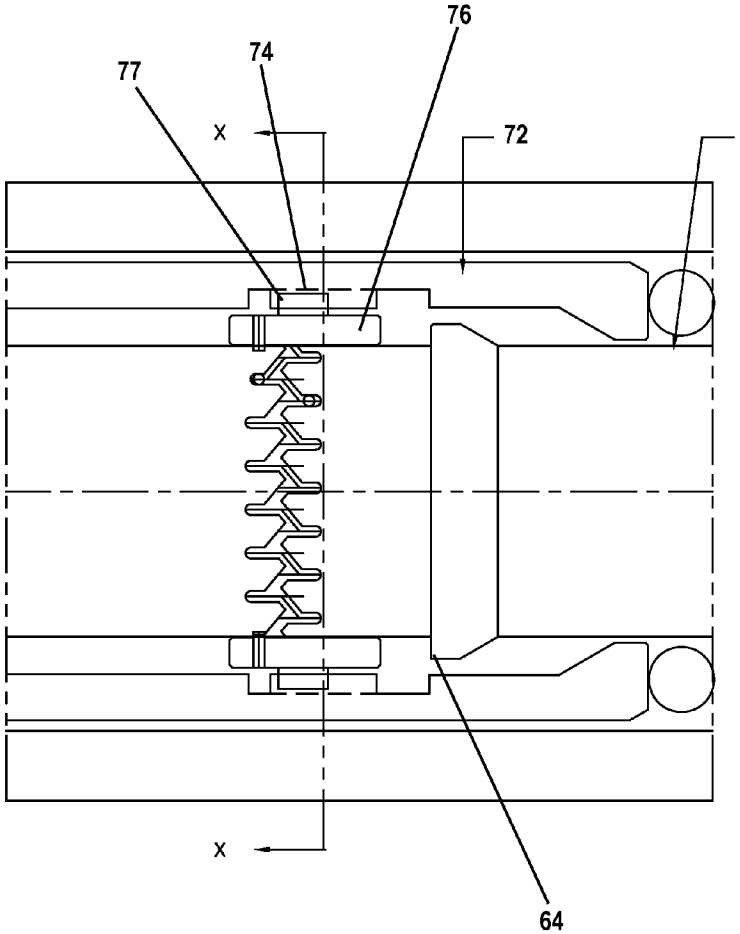

Viewing FIG. 10C, when piston guide 72 moves forward (e.g., when acted on by one or more pistons 45 such as seen in earlier Figures), indexing keys 77 in the channel 73, and thus indexing ring 76, will be moved forward with piston guide 72. This in turn advances indexing pin 78 in indexing grooves 65 similar to the indexing ball movement described in earlier embodiments. The forward movement of indexing ring 76 is limited by shoulder 64 on the mandrel 60 as seen in FIG. 10C. With rearward movement of piston guide 72 (e.g., fluid pressure removed from pistons 45 and the counter force of spring 40), indexing ring 76 returns to the position of FIG. 10A with indexing pin 78 positioned rearward in indexing grooves 65. This forward and rearward movement will cause indexing ring 76 to rotate relative to piston guide 72 until the indexing keys 77 align with the axial key slots 74 formed in piston guide 72. The key slots 74 are sized to receive indexing keys 77 and key slots 74 extend rearward in an axial direction into piston guide 72 as suggested in FIG. 10C. It may be envisioned how, when indexing keys 77 align with key slots 74 (FIG. 10F), piston guide 72 is not limited in forward movement by indexing ring 76 abutting mandrel shoulder 64. Rather, piston guide 72 may now move forward the entire length of key slots 74. FIG. 10E shows indexing keys 77 in the course of moving to their rearmost position in key slots 74. When piston guide 72 has moved to its forward-most position, then in the same manner as seen in FIG. 9B, pistons 45 have moved sufficiently far forward that their seals are clear of the narrow portion of piston cavity 16 such that fluid may flow around pistons 45 and exert an opening force on port sleeve 50 as previously described. Thus, by selective initial placement of indexing keys 77 a certain angular distance from key slots 74 during assembly of the valve, the user may control how many pressure cycles (i.e., forward/rearward movements of indexing pins 78 in indexing grooves 65) are required prior to pistons 45 allowing fluid pressure to be exerted on port sleeve 50 and move port sleeve 50 to the open position.

Figure 11B:
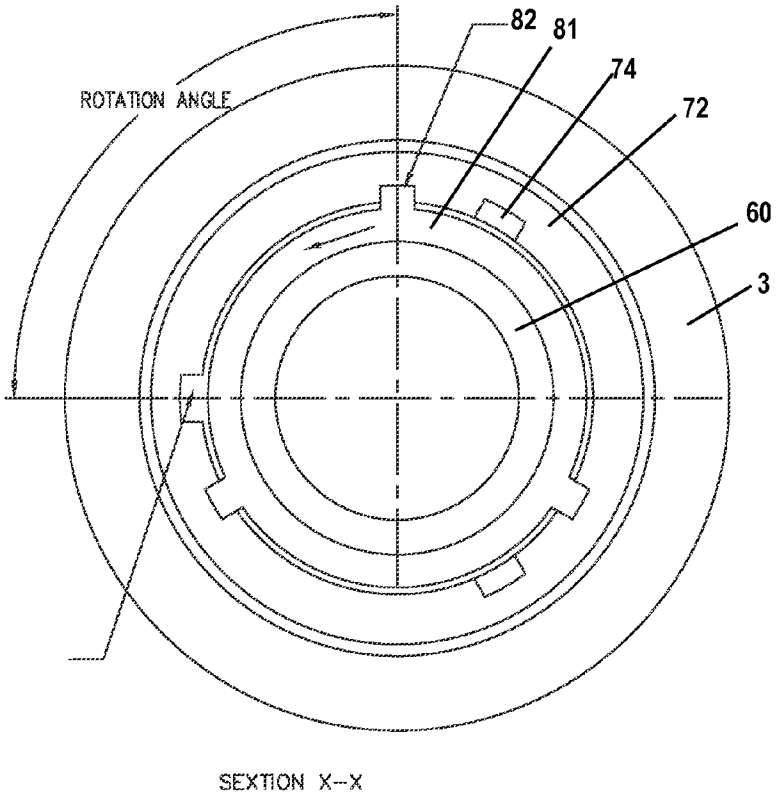
FIGS. 11A and 11B are section views of a third embodiment of an indexing mechanism.
Figure 11A:
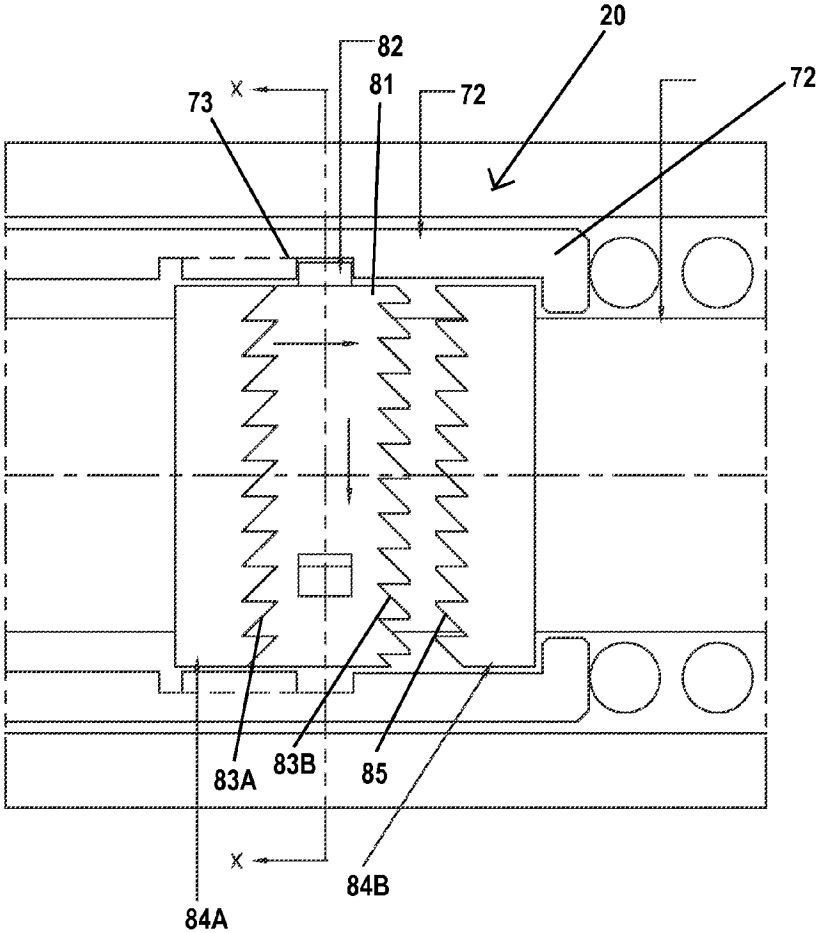

A still further alternate embodiment of the indexing mechanism 20 is seen in FIGS. 11A and 11B. In this embodiment, indexing ring 81 still has an indexing key 82, but indexing ring 81 now includes a series of teeth 83A and 83B on each side of indexing ring 81. Moreover, one sided teeth rings 84A and 84B are fixed to mandrel 60 on each side of indexing ring 81. It will be understood that teeth rings 84A and 84B are fixed against both axial movement and rotation on mandrel 60. Again, indexing keys 82 rotate in circumferential channel 73 in piston guide 72 until the indexing keys 82 encounter key slots 74 seen in FIG. 11B.

It may be envisioned how forward movement of piston guide 72 will first move the teeth of indexing ring 81 into engagement with the teeth of fixed teeth ring 84B, causing a small rotating of indexing ring 81 as the teeth completely mesh. When piston guide 72 moves rearward, the opposing teeth on indexing ring 81 will engage the teeth of fixed teeth ring 84A, causing a further small rotation of indexing ring 81. Thus, repeated pressure cycles will incrementally rotate indexing ring 81 until indexing keys 82 align with indexing slots 74. Thereafter, piston guide 72 moves sufficiently far forward to allow fluid flow around pistons 45 (FIG. 9B) and fluid pressure to open port sleeve 50.

In the FIG. 11A embodiment, the opposing teeth 83A and 83B on indexing ring 81 are offset from or out of phase with one another, while the teeth on fixed teeth rings 84A and 84B are aligned. This ensures that each movement of indexing ring 81 forward or rearward will result in the teeth meshing and a consistent degree of rotation being imparted to indexing ring 81. Naturally, this situation could be reversed with the respective teeth on fixed teeth rings 84A and 84B being offset and the opposing teeth on indexing ring 81 being aligned.

Figure 12:
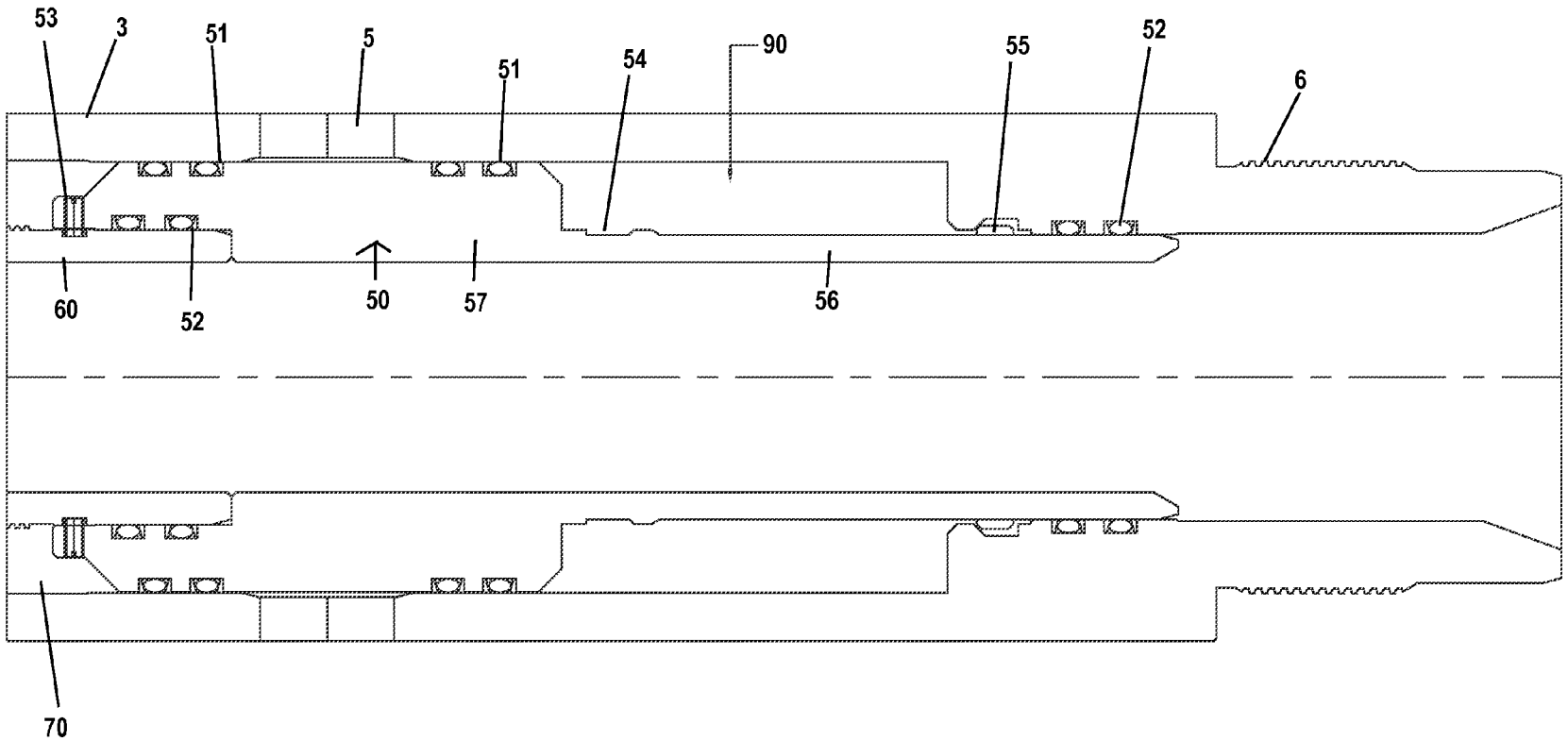
FIG. 12 is a section view of an alternate port sleeve.

FIG. 12 illustrates an alternate embodiment of port sleeve 50. In this embodiment, mandrel 60 does not extend all the way past outer flow ports 5 to form a continuous enclosed annular space 70 as seen in FIG. 1. Rather, in FIG. 12, mandrel 60 terminates short of outer flow ports 5. The port sleeve 50 includes a main sleeve body 57 and a sleeve extension tube 56. An upper section of main sleeve body 57 will have a series of outer ring seals 51 and inner ring seals 52 which engage housing 3 and mandrel 60, respectively, in order to seal the annular space 70 formed above port sleeve 50. Shear screws 53 hold port sleeve 50 in place against an initial predetermined force caused by fluid pressure acting on port sleeve 50. The sleeve extension tube 56 extends below main sleeve body 57 until it engages a second set of inner ring seals 52 and thereby creates a lower annular space or "hydrostatic chamber" 90 between housing 3 and sleeve extension tube 56. Typically when the valve is run into the wellbore, hydrostatic chamber 90 will simply be occupied by air at atmospheric pressure. Alternatively, there may be embodiments where chamber 90 is filled with some other compressible fluid or is simply open to wellbore pressures. However, chamber 90 being filled with air at atmospheric pressure reduces the pressure which needs to be applied in annular space 70 in order to shear screws 53. Sleeve extension tube 56 also includes a lock ring groove 54 which moves into engagement with the split lock ring 55 when port sleeve 50 moves to the fully open position (thus locking port sleeve 50 in the open position).

The pressures at which the indexing mechanisms function may vary greatly from one embodiment to another. Factors affecting the operating pressure include the depth at which the tool will be used, the density of the fluid being circulated in the wellbore, and the strength of the materials from which the tool is constructed. As one nonlimiting example, it may be that the well operator wishes to pressure test the tubing string up to a pressure of 10,000 psi. It would be undesirable to force the tool to operate at pressures above the maximum intended test pressure. Likewise, it is necessary for the burst disk to not rupture at the pressures expected to be encountered in various casing installation procedures, e.g., the cementing stage. Therefore, where 10,000 psi is the maximum test pressure, it may be desirable to have the burst disks rupture at approximately 7,000 psi. Spring 40 may be sized such that the pressure needed for indexing mechanism 20 to overcome the spring force (and piston seal friction) is approximately 8,000 or 9,000 psi. As explained previously, the spring force may also be adjusted with spring nut 43.

The terms "forward," "rearward," "up," and "down" are merely used to describe the illustrated embodiments. Those skilled in the art will readily recognize the various components could be arranged in many alternative configurations. For example, the indexing mechanism could be positioned "below" the port sleeve. Likewise, the indexing grooves could be formed on some component other than the mandrel, or traverse in a direction other than "up" and "down" the length of the tool. Further, many different indexing mechanisms beside the one shown in the figures could be employed. All such variations and modifications are intended to come within the scope of the following claims.

The invention claimed is:

1. A downhole valve comprising:

a. an outer tubular member including at least one outer flow port;

b. an inner tubular member positioned at least partially within the outer tubular member and forming an annular space therebetween, the inner tubular member including a central flow passage;

c. a port sleeve positioned to selectively block communication between the outer flow port and the central flow passage;

d. an indexing assembly positioned at least partially within the annular space, the indexing assembly comprising (i) an indexing groove formed in a generally forward and rearward direction; (ii) an indexing member traveling in the indexing groove, wherein fluid pressure from the central passage moves the indexing assembly in one direction, a spring moves the indexing assembly in an opposing direction, and the indexing assembly is configured to allow communication between the central flow passage and the annular space after a plurality of forward/rearward movements of the indexing assembly; and e. wherein the port sleeve is configured to shift and allow communication between the outer flow port and the central passage when acted upon by increasing fluid pressure in the annular space.

2. The downhole valve of claim 1, wherein the inner tubular member includes at least one inner flow port and the port sleeve is positioned in the annular space to block fluid communication between the outer flow port and the inner flow port.

3. The downhole valve of claim 1, wherein (i) a first section of the port sleeve is at least partially positioned in the annular space when the port sleeve blocks the outer flow port, and (ii) a second section of the port sleeve extends beyond an end of the inner tubular member to form a second annular space between the second section of the port sleeve and the outer tubular member.

4. The downhole valve of claim 1, wherein the indexing groove is formed in a zigzag pattern.

5. The downhole valve of claim 4, wherein the zigzag pattern includes a plurality of leg segments with a final leg segment being longer than previous leg segments.

6. The downhole valve of claim 1, wherein the indexing member is a ball.

7. The downhole valve of claim 1, wherein at least one piston with a first end operates on the indexing assembly and a second end of the piston is exposed to fluid pressure from the central flow passage.

8. The downhole valve of claim 7, wherein a pressure activation device is positioned over the aperture in the valve wall.

9. The downhole valve of claim 8, wherein the pressure activation device is a burst disc.

10. The downhole valve of claim 1, wherein the indexing mechanism comprises (i) an indexing ring rotating on the inner tubular member; (ii) at least one indexing key extending radially outward from the indexing ring; (iii) a piston guide having a key slot corresponding to the indexing key; and (iv) wherein the piston guide has a first range of axial travel relative to the indexing ring when the indexing key and key slot are unaligned, and a second, greater range of axial travel when the indexing key and key slot are aligned.

11. A toe valve comprising:

a. a top sub:

b. an outer tubular member including a plurality of outer flow ports, a first end of the outer tubular member being fixed to the top sub;

b. an inner tubular member positioned at least partially within the outer tubular member and forming an annular space therebetween, the inner tubular member (ii including a central flow passage and a plurality of inner flow ports, and (ii) including a first end fixed to the top sub such that the inner tubular member cannot move axially with respect to the top sub;

c. a port sleeve positioned in the annular space to selectively block communication between the outer flow ports and the inner flow ports;

d. an indexing mechanism positioned at least partially within the annular space, the indexing mechanism comprising an indexing groove formed in a zigzag pattern and an indexing member traveling in the indexing groove;

e. a flow path allowing fluid pressure from the central passage to act against a first side of the indexing mechanism;

f. a biasing device acting on a second side of the indexing mechanism;

g. wherein the indexing mechanism is configured to allow communication between the central flow passage and the annular space after a plurality of forward/rearward movements of the indexing mechanism; and h. wherein the port sleeve is configured to shift and allow communication between the outer flow port and the central passage when acted upon by increasing fluid pressure in the annular space.

12. The toe valve of claim 11, wherein the indexing groove is positioned on an outer surface of the inner tubular member.

13. The toe valve of claim 11, wherein an indexing ring retains the indexing member in the indexing groove and rotates with the forward/rearward movement of the indexing mechanism.

14. The toe valve of claim 11, wherein the indexing mechanism comprises a piston guide, an indexing ring, and a piston cap.

15. The toe valve of claim 11, wherein the indexing mechanism is configured to connect the central flow passage with an annular space between the inner and outer tubular members, such that fluid pressure may act on a port sleeve initially covering the outer flow port.

16. A downhole valve comprising:

a. an outer tubular member including at least one outer flow port;

b. an inner tubular member positioned at least partially within the outer tubular member and forming an annular space therebetween, the inner tubular member including a central flow passage;

c. a port sleeve positioned to selectively block communication between the outer flow port and the central flow passage;

d. an indexing assembly positioned at least partially within the annular space, the indexing assembly comprising (i) an indexing surface formed in a generally forward and rearward direction; (ii) an indexing member traveling to engage the indexing surface and to generate rotative motion when engaging the indexing surface, wherein fluid pressure from the central passage moves the indexing assembly in one direction, a biasing device moves the indexing assembly in an opposing direction, and the indexing assembly is configured to allow communication between the central flow passage and the annular space after a plurality of forward/rearward movements of the indexing assembly; and e. wherein the port sleeve is configured to shift and allow communication between the outer flow port and the central passage when acted upon by increasing fluid pressure in the annular space.

17. The downhole valve of claim 16, wherein the indexing surface is a tooth pattern.

18. The downhole valve of claim 17, wherein the indexing member has a corresponding tooth pattern to engage the tooth pattern of the indexing surface.

19. The downhole valve of claim 18, wherein the indexing member comprises an indexing ring encircling the inner tubular member and having teeth on opposing surfaces.

20. The downhole valve of claim 19, further comprising two indexing surfaces encircling the inner tubular member, with one indexing surface on each side of the indexing member.

21. The downhole valve of claim 20, wherein (i) the indexing ring rotates on the inner tubular member; (ii) at least one indexing key extends radially outward from the indexing ring; (iii) the indexing assembly includes a piston guide having a key slot corresponding to the indexing key; and (iv) wherein the piston guide has a first range of axial travel relative to the indexing ring when the indexing key and key slot are unaligned, and a second, greater range of axial travel when the indexing key and key slot are aligned.

* * * * *